US006868758B2

(12) United States Patent
Chen

(10) Patent No.: US 6,868,758 B2
(45) Date of Patent: Mar. 22, 2005

(54) JOINT FOR CONNECTING WRENCH WITH SOCKET

(76) Inventor: Terence Chen, No. 325, Yung Ching Rd., Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/437,789

(22) Filed: May 14, 2003

(65) Prior Publication Data

US 2004/0226413 A1 Nov. 18, 2004

(51) Int. Cl.[7] ..... B25B 13/46

(52) U.S. Cl. ..... 81/60; 81/61; 81/62; 81/63

(58) Field of Search ..... 81/60, 61, 62, 81/63, 63.1, 63.2

(56) References Cited

U.S. PATENT DOCUMENTS 6,568,299 B2 * 5/2003 Hu ..... 81/63.2
6,601,476 B2 * 8/2003 Hu ..... 81/60
6,691,593 B2 * 2/2004 Hu ..... 81/60

* cited by examiner

*Primary Examiner*—Joseph J. Hail, III
*Assistant Examiner*—Alvin J. Grant
(74) *Attorney, Agent, or Firm*—Alan D. Kamrath; Nikolai & Mersereau, P.A.

(57) ABSTRACT

A joint apparatus is provided for firmly connecting a head of a wrench with a socket. The joint apparatus includes a joint and a retainer. The joint includes a first portion for releasable engagement with the head of the wrench and a second portion for releasable engagement with a socket. The retainer is attached to the first portion of the joint for abutting the head of the wrench, thus avoiding the joint escaping the head of the wrench.

5 Claims, 5 Drawing Sheets

JOINT FOR CONNECTING WRENCH WITH SOCKET

FIELD OF INVENTION

The present invention relates to a joint for connecting a wrench with a socket.

BACKGROUND OF INVENTION

Taiwanese Patent Publication No. 483368 discloses a wrench 40 and a joint 1 for connecting the wrench 40 with sockets 20. The wrench 40 includes a box end and an open end. The joint 1 includes a hexangular portion 10, a small square insert 11 extending from an end of the hexangular portion 10 and a large square insert 12 extending from an opposite end of the hexangular portion 10. In use, the hexangular portion 10 is inserted in the box end of the wrench 40. The small square insert 11 is inserted in a square hole defined in a small socket 20 or the large square insert 12 in a square hole defined in a large socket 20. The hexangular portion 10 is apt to fall from the box end of the wrench 40 although a ball detent 103 is used to retain the hexangular portion 10 in the box end of the wrench 40.

The present invention is therefore intended to obviate or at least alleviate the problem encountered in the prior art.

SUMMARY OF INVENTION

It is the primary objective of the present invention to provide a joint apparatus for firmly connecting a head of a wrench with a socket.

According to the present invention, a joint apparatus includes a joint and a retainer. The joint includes a first portion for releasable engagement with a head of a wrench and a second portion for releasable engagement with a socket. The retainer is attached to the first portion of the joint for abutting the head of the wrench, thus avoiding the joint escaping the head of the wrench.

Other objectives, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
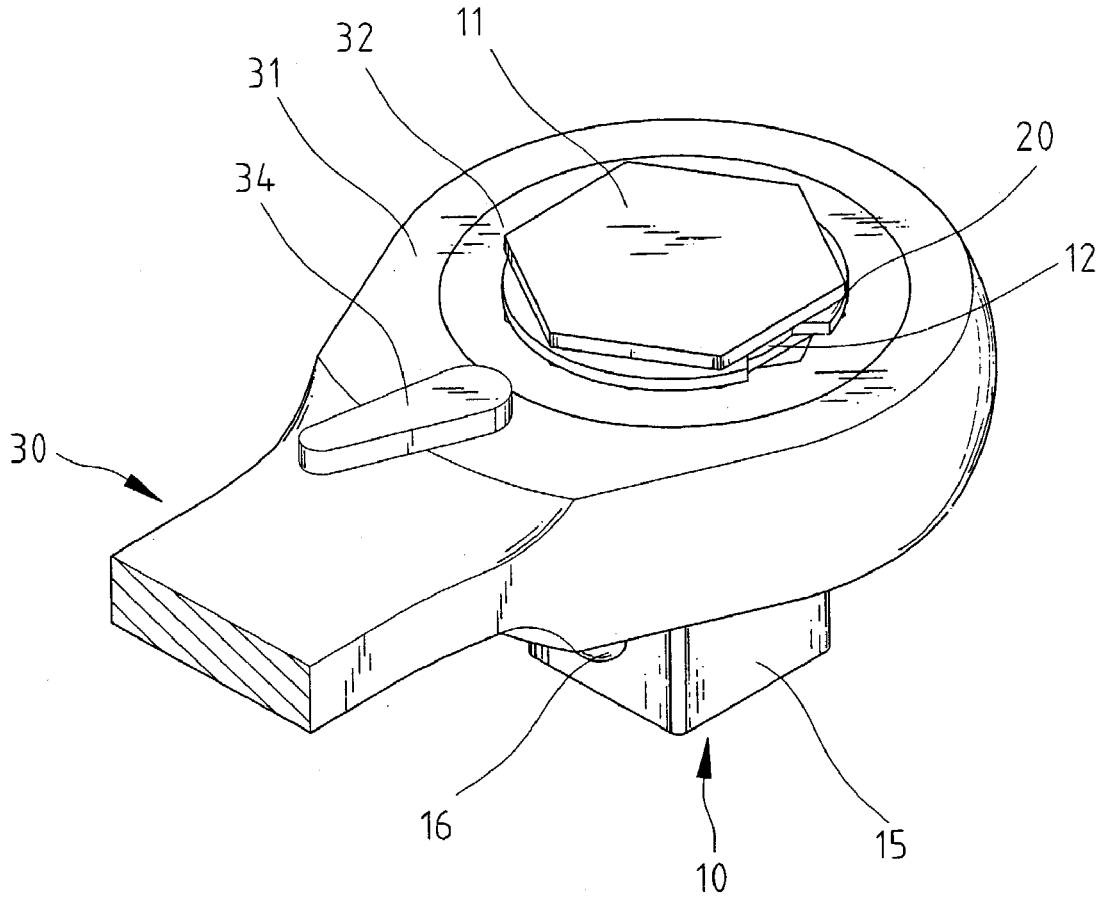
FIG. 1 is a perspective view of a socket wrench equipped with a joint according to a first embodiment of the present invention.
Figure 2:
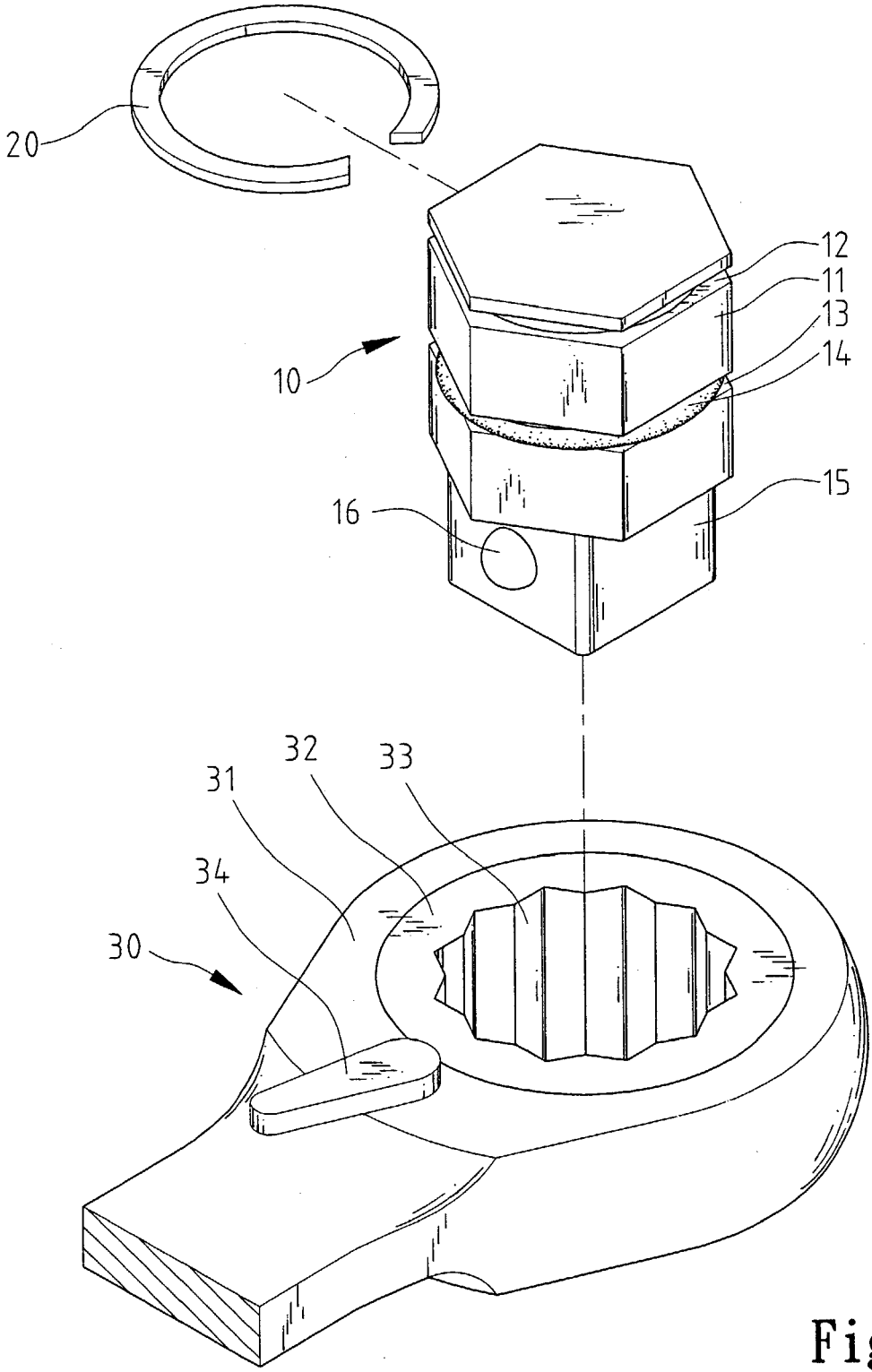
FIG. 2 is an exploded view of the socket wrench shown in FIG. 1.
Figure 3:
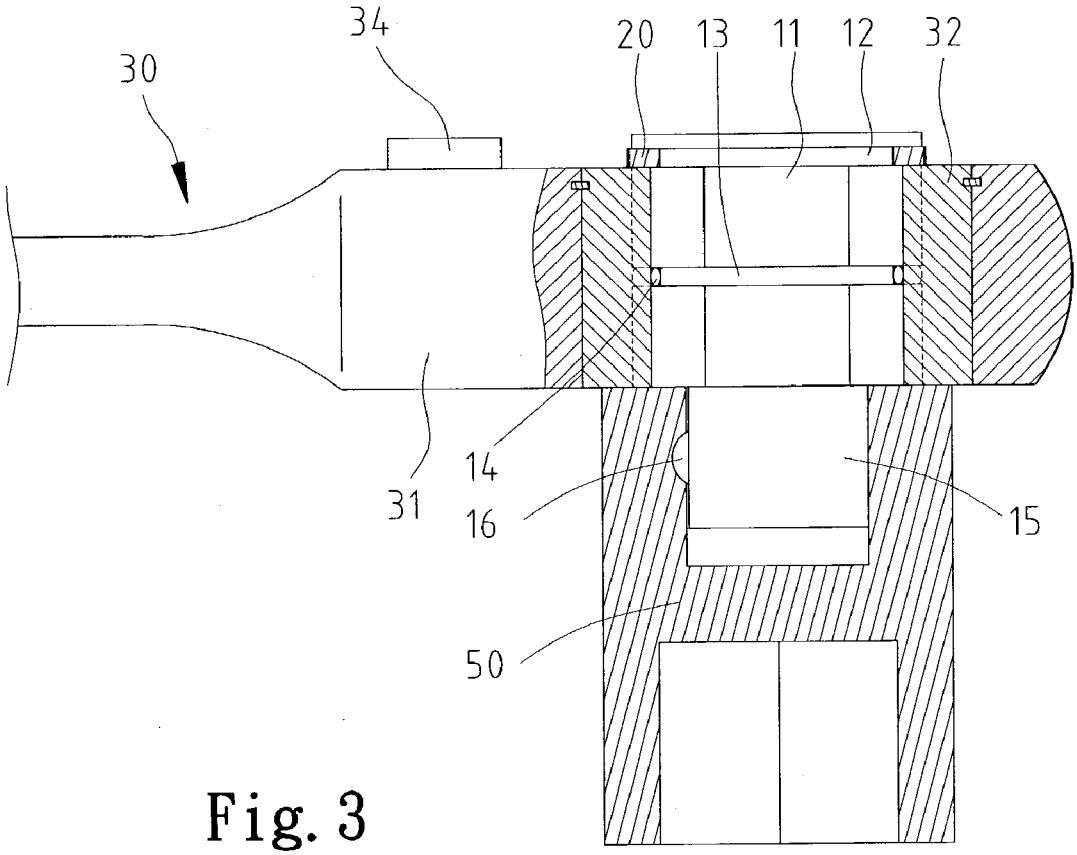
FIG. 3 is a partially cross-sectional view of the socket wrench shown in FIG. 1.

Referring to FIGS. 1–3, a socket wrench 30 is equipped with a joint 10 according to a first embodiment of the present invention.

The socket wrench 30 includes a handle (not numbered and shown partially), an annular head 31 integrated with the handle, a ring 32 put in the annular head 31 and formed with a star-shaped internal face 33 for engagement with the joint 10, a direction controller (not shown) arranged between the annular head 31 and the ring 32 and a switch 34 mounted on the annular head 31 and connected with the direction controller. The socket wrench 30 will not be described in detail for being conventional.

The joint 10 includes a hexangular portion 11 and a square portion 15 formed at a lower end of the hexangular portion 11. The hexangular portion 11 is for engagement with the ring 32. Upper and lower annular grooves 12 and 13 are defined in the hexangular portion 11. An O-ring 14 is put in the lower annular groove 13. A C-clip 20 is put in the upper annular groove 12. A detent 16 is installed at the square portion 15.

In use, the hexangular portion 11 is inserted in the ring 32. The O-ring 14 provides frictional contact with the ring 32 for retaining the hexangular portion 11 in the ring 32. The C-clip 20 is put against the ring 32, thus avoiding the joint 10 escaping the ring 32. The square portion 15 is inserted in a square hole defined in a socket 50. The detent 16 retains the square portion 15; in the socket 50.

Figure 4:
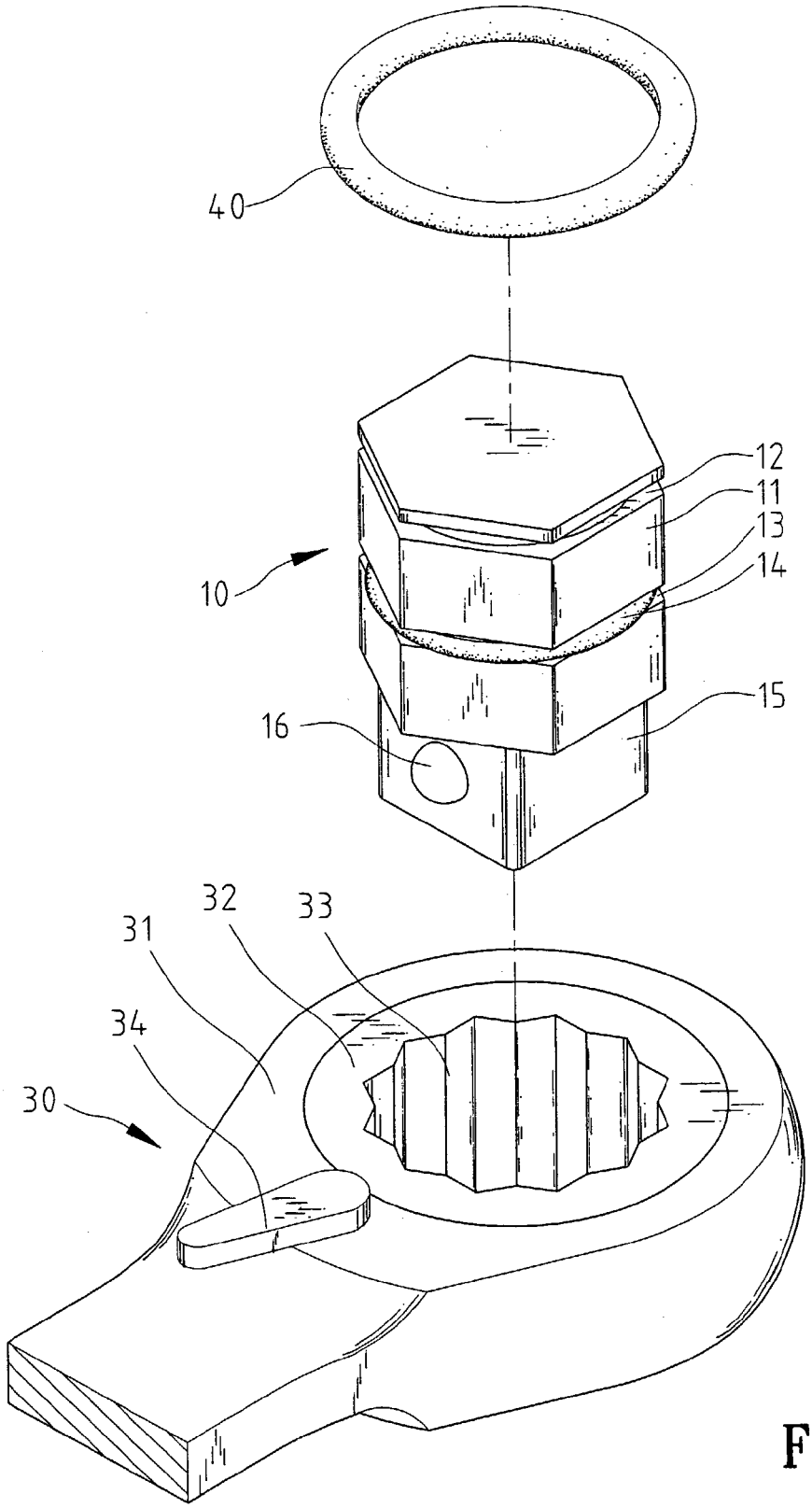
FIG. 4 is an exploded view of a socket wrench equipped with a joint according to a second embodiment of the present invention.
Figure 5:
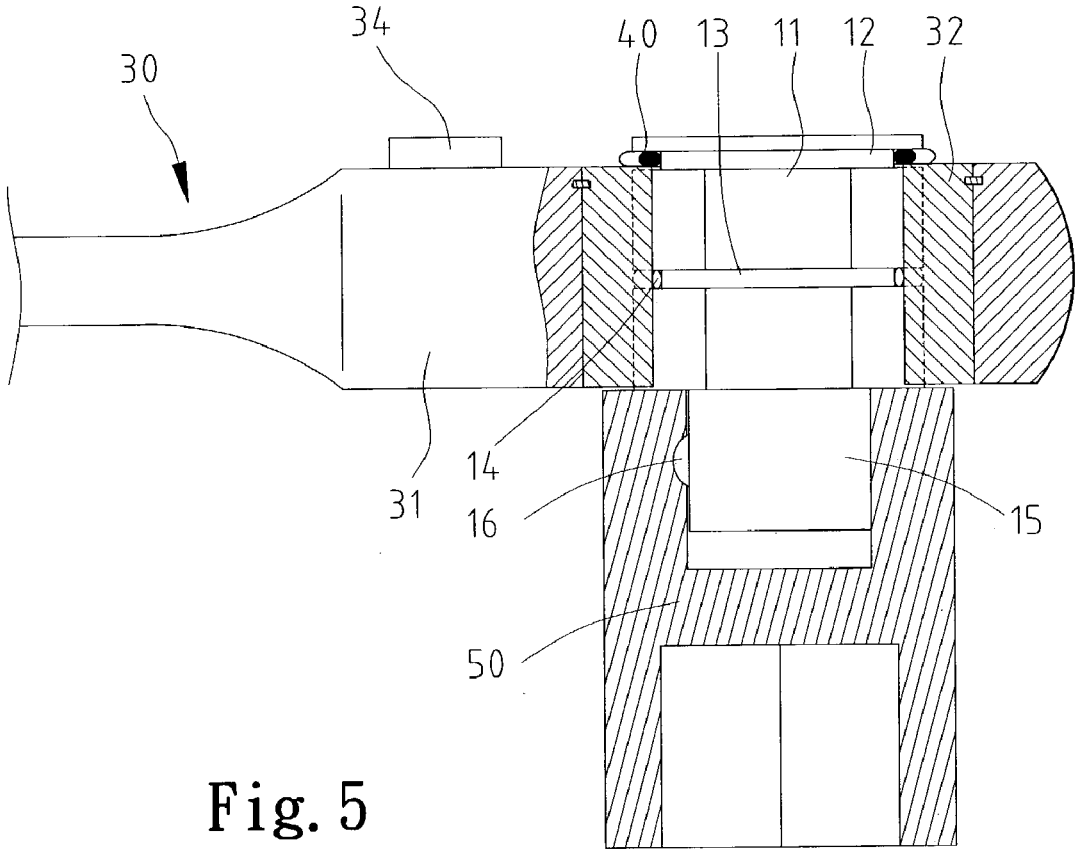
FIG. 5 is a partially cross-sectional view of the socket wrench shown in FIG. 4.

FIGS. 4 and 5 show the socket wrench 30 equipped with a joint 10 according to a second embodiment of the present invention. The second embodiment is identical to the first embodiment except for including an O-ring 40 instead of the C-clip 20. The O-ring 40 is put against the ring 32, thus avoiding the joint 10 escaping the ring 32.

The present invention has been described via detailed illustration of embodiments. Those skilled in the art can derive variations from the embodiments without departing from the scope of the present invention. Therefore, the embodiments shall not limit the scope of the present invention defined in the claims.

What is claimed is:

1. A joint apparatus for firmly connecting a head of a wrench with a socket, the joint apparatus including:

a joint with a first portion for releasable engagement with the head of the wrench and a second portion for releasable engagement with a socket;

a retainer removably attached to the first portion of the joint for abutting the head of the wrench, thus avoiding the joint escaping the head of the wrench; and an auxiliary retainer attached to the first portion of the joint for frictional contact with the head of the wrench, wherein the joint includes a first annular groove defined in the first portion for receiving the auxiliary retainer, wherein the auxiliary retainer is an O-ring, wherein the joint includes a second annular groove defined in the first portion for removably receiving the retainer, with the second annular groove being axially spaced on the joint from the first annular groove.

2. The joint apparatus according to claim 1 wherein the first portion is a hexangular portion.

3. The joint apparatus according to claim 1 wherein the second portion is a square portion.

4. The joint apparatus according to claim 1 wherein the retainer is a C-clip.

5. The joint apparatus according to claim 1 wherein the retainer is an O-ring.

* * * * *